United States Patent [19]

deVreeze et al.

[11] Patent Number: 4,555,195

[45] Date of Patent: Nov. 26, 1985

[54] PAINTING TOOL

[75] Inventors: Joop J. deVreeze, Veendam; Zwier Tijssen, Sportlaan, both of Netherlands; Daniel Doorley, Salem, Mass.

[73] Assignee: Multigood, b.v., Netherlands

[21] Appl. No.: 514,227

[22] Filed: Jul. 15, 1983

[51] Int. Cl.[4] ..... B43M 11/02; B05C 17/02

[52] U.S. Cl. ..... 401/218; 401/208; 401/219; 403/91

[58] Field of Search ..... 401/208, 218, 219, 220; 403/91

[56] References Cited

U.S. PATENT DOCUMENTS

| | | | |
|---|---|---|---|
| 297,882 | 4/1884 | Waggonner | 403/91 |
| 375,919 | 1/1888 | Boyle | 401/219 |
| 2,528,657 | 11/1950 | Hobe, Sr. | 401/218 |
| 3,128,494 | 4/1964 | Hohmann . | |
| 3,263,263 | 8/1966 | Munn . | |
| 3,263,264 | 8/1966 | Leland . | |
| 3,356,442 | 12/1967 | Leland . | |
| 3,850,532 | 11/1974 | Kaiser | 401/219 |
| 4,012,152 | 3/1977 | Lupkes | 401/218 |
| 4,093,386 | 6/1978 | Lundgren et al. | 401/219 |

FOREIGN PATENT DOCUMENTS

| | | | |
|---|---|---|---|
| 164488 | 11/1949 | Austria | 401/218 |
| 843007 | 6/1939 | France | 401/218 |
| 1194620 | 11/1959 | France | 401/218 |
| 746499 | 3/1956 | United Kingdom . | |
| 850427 | 10/1960 | United Kingdom | 401/218 |
| 1330832 | 9/1973 | United Kingdom | 401/218 |

*Primary Examiner*—Steven A. Bratlie

*Attorney, Agent, or Firm*—McDermott, Will & Emery

[57] ABSTRACT

A painting tool, with an internal paint reservoir that feeds paint to a roller in a relatively continuous fashion, is manipulated through an adjustable handle. The roller housing includes a pair of brackets defining a convex surface. The handle telescopically passes through the convex surface and is encircled by a ring which threads about the handle. The ring is cammed to move towards and away from the spherical surface on the roller housing, when the ring is rotated. Since the ring includes a concave surface, the translation of the ring with respect to the convex surface on the roller enables locking engagement to be attained between the handle and the roller housing. In this way the handle may be selectively fixed with respect to the roller in one of a plurality of relative angular orientations to facilitate painting. The roller housing may include a pair of rollers in fluid communication with one another and with the paint reservoir, such that paint, fed from the reservoir to a first roller, is transferred to the rotating second roller and then to the surface to be painted. The first roller includes a pair of end portions sized to sealingly abut with the roller housing and an intermediate portion of somewhat smaller diameter for transferring paint to the second roller. For this purpose, the intermediate portion may include a plurality of outwardly directed ribs or raised portions which carry the paint received from the reservoir onto the second roller.

1 Claim, 16 Drawing Figures

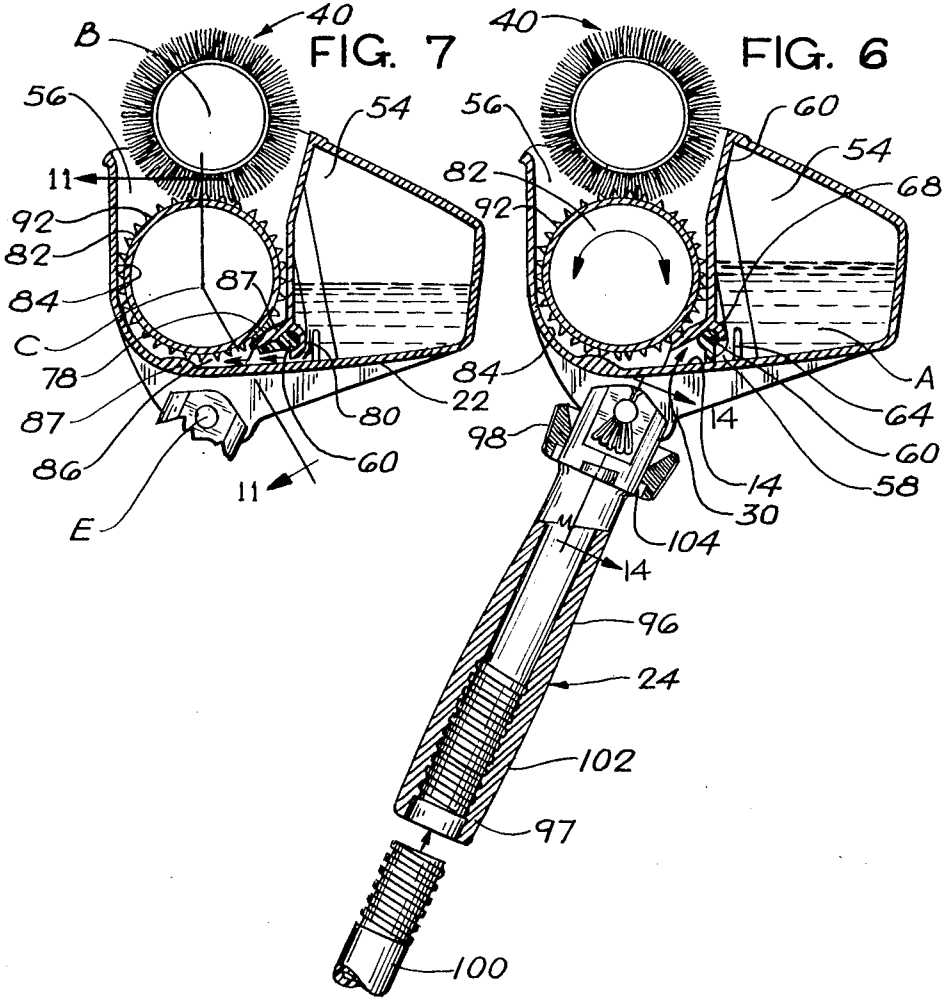
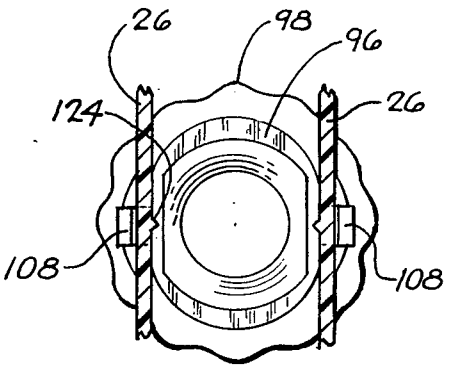
FIG. 15
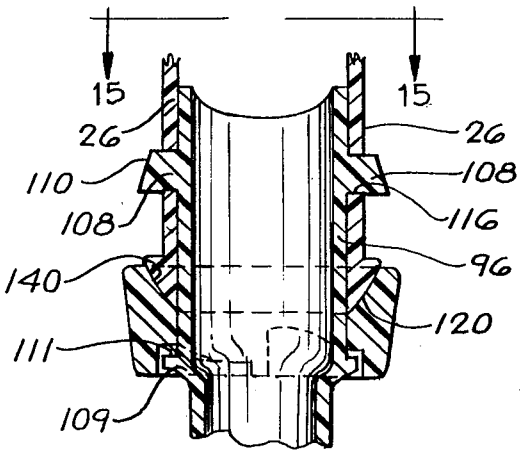
FIG. 14

PAINTING TOOL

BACKGROUND OF THE INVENTION

1. Field of the Invention

This invention relates generally to paint applying rollers and particularly to such rollers that include an internal paint reservoir.

2. Description of the Background Art.

A number of paint applicators which include internal paint reservoirs have been known in the art. For example, devices including an internal paint reservoir and a single paint applicating roller which receives paint from the reservoir are disclosed in U.S. Pat. Nos. 375,919, 3,263,264, 3,356,442 and 3,850,532. In addition devices have been known in the past which include both an internal reservoir and a transfer roller to transfer paint from the reservoir to a second roller in contact with the surface to be painted. U.S. Pat. Nos. 2,528,657, 3,128,494, 3,263,263, and 4,012,152 together with British Pat. No. 746,499, published Mar. 14, 1956, all disclose such devices. Several of these patents disclose valves for regulating the flow of paint from the reservoir to the roller. U.S. Pat. No. 3,263,263 to Munn discloses a paint roller device with an internal reservoir and an adjustable handle.

While the devices described in these patents could achieve certain advantages, there is a continuing demand for more efficient devices of this type. Particularly, due to their large size, and their propensity to leak, these devices have not received considerable commercial attention in the past. Thus, it would be highly desirable to provide such a device that may be more easily operated and which is less prone to leakage problems.

SUMMARY OF THE INVENTION

It is, therefore, a primary object of the present invention to provide a painting tool with an internal paint reservoir including a handle which facilitates the positioning of the tool with respect to the surface being painted.

It is still another object of the present invention to provide such a painting tool with a handle which may be adjusted to a variety of orientations with respect to the body or housing of the painting tool, using only a single simple motion.

It is yet another object of the present invention to provide a painting tool with a second or transfer roller for efficiently transferring paint from the reservoir to the applicating roller and also preventing leakage of paint from the reservoir out from the sides of the rollers.

Yet another object of the present invention to provide such a device which defines a second, smaller reservoir in the region adjacent to the transfer roller, contained at least in part by the configuration of the transfer roller.

These and other objects of the present invention are achieved by a painting tool that includes a paint applying element and a handle mounting portion connectable to the paint applying element. The handle mounting portion includes a generally spherical mounting surface. A handle is pivotally connectable to the handle mounting portion. A clutch means includes a generally spherical clutch surface for releasably fixing the handle on the handle mounting portion at a plurality of relative angular orientations. The clutch means is adapted to encircle the handle and is arranged to translate with respect to the handle in response to rotation of the clutch means about the handle between a first position and a second position. The first position is achieved when the clutch surface is spaced from the mounting surface and the second position is accomplished with the clutch surface frictionally engaging the mounting surface.

In accordance with another embodiment of the present invention, a painting tool includes a housing with a handle and a first paint roller rotatably mounted within the housing. A second paint roller is rotatably mounted within the housing in rotating engagement with the first paint roller such that paint may be transferred from the surface of the second paint roller to the surface of the first paint roller. The second paint roller has a pair of end portions and an intermediate portion between the end portions. The end portions have a larger diameter than the intermediate portion and are arranged to rotate in sealing abutment with the housing. The intermediate portion has a plurality of axially extending, paint transferring projections spaced circumferentially about the second paint roller. A paint reservoir is defined within the housing in fluid roller.

BRIEF DESCRIPTION OF THE DRAWING

FIG. 6 is a cross-sectional view taken generally along the line 6—6 in FIG. 4;

FIG. 7 is a partial cross-sectional view taken along the line 6—6 in FIG. 4 but with the valve in its open position;

FIG. 14 is a cross-sectional view taken generally along the line 14—14 in FIG. 6; and FIG. 15 is a cross-sectional taken generally along the line 15—15 in FIG. 14.

DETAILED DESCRIPTION OF THE PREFERRED EMBODIMENT

Figure 1:
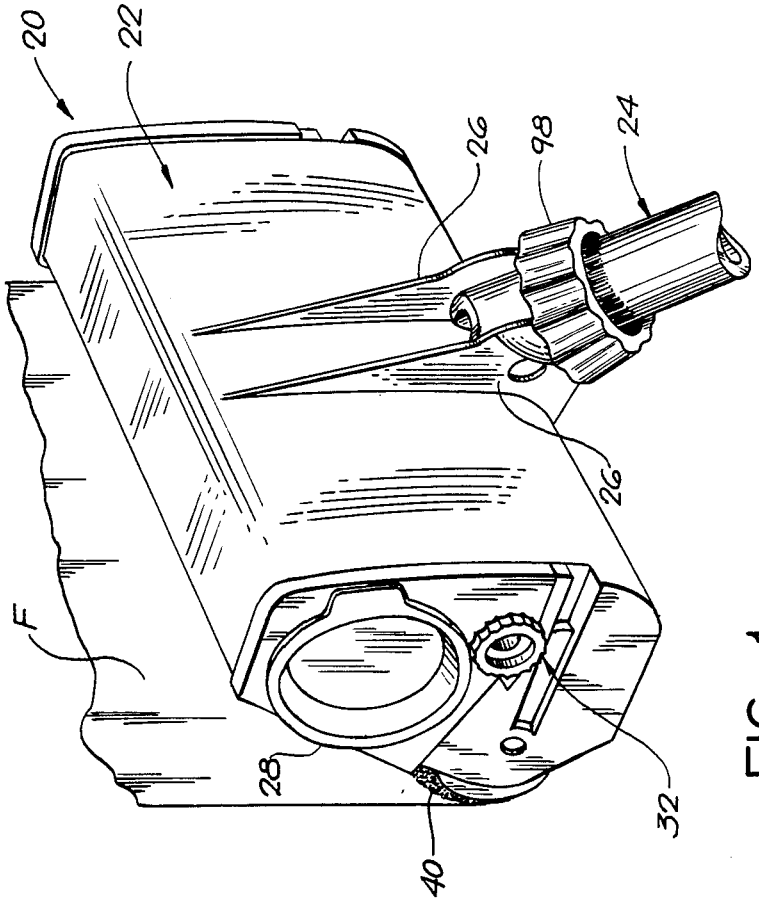
FIG. 1 is a partially cutaway perspective view of one embodiment of the present invention.

Referring to the drawing wherein like reference characters are used for like parts throughout the several views, a painting tool 20, shown in FIG. 1, includes a somewhat egg-shaped housing 22 and an adjustably positionable handle 24, removably connectable to the housing 22. The housing 22 includes a pair of spaced, parallel brackets 26 that mount the handle 24.

Figure 2:
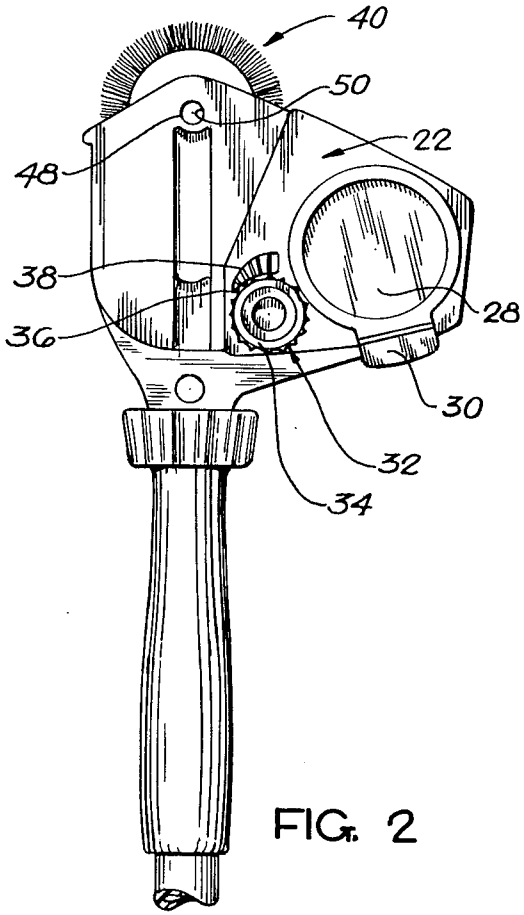
FIG. 2 is a side elevational view of the embodiment shown in FIG. 1.

The housing 22 includes a removable filling cap 28, shown in FIG. 2. The cap 28 includes a manually graspable flange 30 grasped by the user to remove the cap 28 from the housing 22. Conveniently the cap 28 is held in sealing engagement within an opening in the housing 22 by friction. The housing 22 also includes a flow adjustment valve 32 with an indicator portion 34 exposed on the outside of the housing 22. The indicator portion 34 includes a pointer 36 arranged in proximity to a scale 38 defined on the outside of the housing 22.

Figure 9:
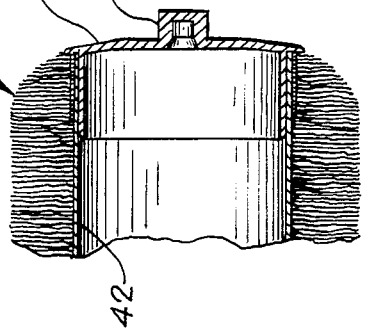
FIG. 9 is a partial cross-sectional view of the applicator roller.
Figure 3:
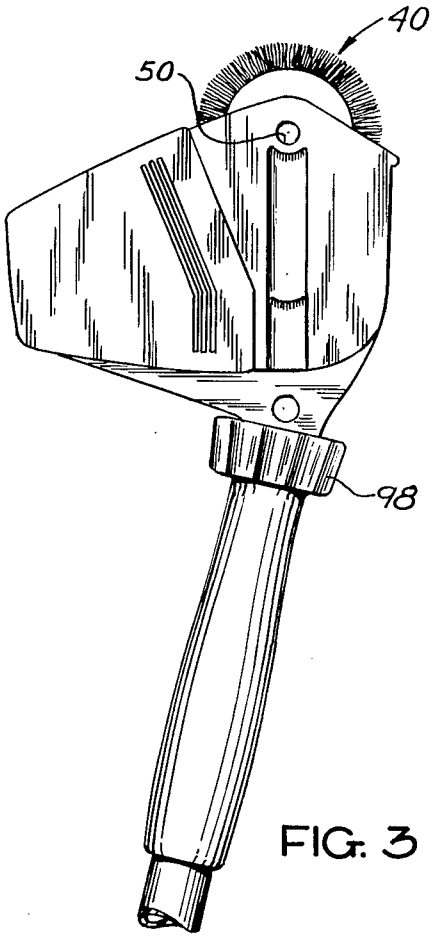
FIG. 3 is an opposite side elevational view of the embodiment shown in FIG. 1.
Figure 5:
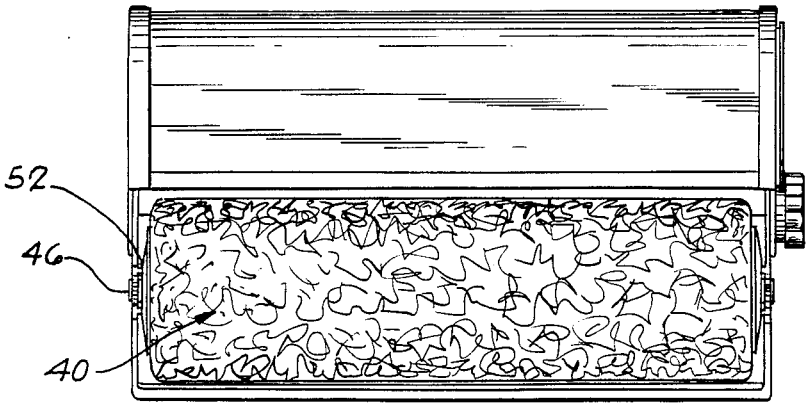
FIG. 5 is a top plan view of the embodiment shown in FIG. 1.

As shown in FIGS. 2 through 5, an applicator paint roller 40 extends outwardly of the housing 22 to enable roller style painting. The roller 40 includes a cover 42 that may be of any conventional design. The housing 22 also includes a pair of shields 44 facing inwardly towards one another to contact the roller 40 end walls 46 and to guide the rotation of the roller 40 in contact with the surface to be painted. As indicated in FIG. 9, the end walls 46, retained by friction, are removably positionable within the interior of the cover 42. Each end wall 46 includes an outwardly extending stub axle 48. As indicated in FIGS. 2 and 3, each stub axle 48 is removably received within an opening 50 in the inside wall of the housing 22. Moreover, as indicated in FIG. 5, a pair of opposed, inwardly directed guides 52 are defined on the interior surface of the housing 22, to guide the insertion and removal of the roller 40 and particularly its stub axles 48. Conveniently, the housing 22 is made of flexible material, such as plastic, so that the roller 40 can be snapped in and out of the housing 22.

As shown in FIGS. 6 and 7, the interior of the housing 22 is divided into a paint-containing reservoir 54 and an open, elongated roller receiving slot 56. The reservoir 54 provides an essentially closed container in the narrower portion of the housing 22, fillable by removing the cap 28. The paint, indicated as "A" in FIG. 6, within the reservoir 54 is inclined to flow through an elongated opening 58 defined in the wall 60 that separates the reservoir 54 from the slot or cavity 56. The flow of paint through the paint supplying opening 58 is controlled by a rotary valve 32. In addition the opening 58 is guarded by a tab 64 which prevents the entry of larger particulates such as pieces of dried paint which would otherwise clog the valve 32.

Figure 8:
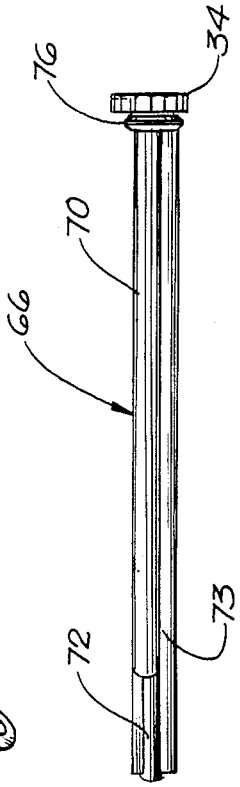
FIG. 8 is a front elevational view of the valve stem shown in FIG. 6 removed from its housing.

The rotary valve 32 includes a stem 66 that is removably positionable within the housing 22 and a valve casing 68, formed, in the illustrated embodiment, integrally with the wall 60. As shown in FIG. 8, the stem 66 includes a larger diameter journalled portion 70 and a smaller thickness wiper portion 72 with a wiper 73 extending diametrically away from the wiper portion 72 and journalled portion 70. The journalled portion 70 is journalled within the generally cylindrical casing 68, although the wiper portion 72 extends outwardly of the casing 68 to a position adjacent to the lower housing wall 74. The stem 66 is inserted into and is removable from the housing 22 by way of an opening, by sliding it along the length of the valve casing 68 until it impacts against the opposite wall of the housing 22. Since the lower portion of the valve casing 68 is open, the wiper 73 may be pivoted towards and away from the reservoir 54 by operating the indicator portion 34 which is integral with the journalled portion 70 and the wiper portion 72, in the illustrated embodiment. A disc-shaped portion 76 is formed integrally on the stem 66 adjacent to the pointer 36. The disc-shaped portion 76 has a slightly humped configuration such that the stem 66 may be frictionally snapped into and out of the receiving opening in the housing 22.

As indicated in FIGS. 6 and 7, the valve casing 68 includes a slot segment 78 extending into the slot 56 and a reservoir stop 80 positioned within the reservoir 54. The segment 78 and stop 80 control the arc of movement of the stem 66 within the valve housing 68. Thus, the valve stem 66 may be pivoted to any position from the downwardly pointing position, shown in FIG. 6, with the wiper 73 pressed against the lower housing wall 74 to the position, shown in FIG. 7, pressed against the slot segment 78 and providing a fluid passage from the reservoir 54 to the slot 56. The stem 66 is held in the desired position by friction between the journalled portion 70 and the housing 68.

The slot 56 contains a transfer paint roller 82 and the applicator paint roller 40. About half of the circumference of the applicator paint roller 40 extends outwardly of the slot 56, in the illustrated embodiment while the transfer paint roller 82 is illustrated as being contained wholly within the slot 56. Both the transfer paint roller 82 and the applicator paint roller 40 rotate within the slot around generally parallel axes such that the two rollers are in surface contact.

The periphery of the transfer paint roller 82 is in sliding contact with the internal wall 84 of the slot 56. Preferably the internal wall 84 has a generally cylindrical shape such that there is a mating, conforming relationship between the transfer paint roller 82 and the internal wall 84. This helps to prevent paint from leaking out around the sides of the transfer paint roller 82 and dripping out of the slot 56.

Figure 11:
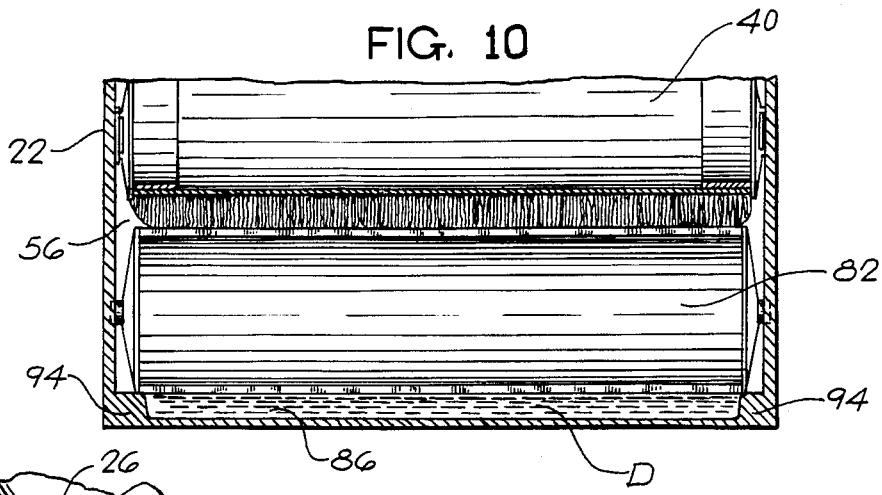
FIG. 11 is a partial cross-sectional view taken generally along the line 11—11 in FIG. 7.

A secondary paint reservoir 86 is defined by the humps 87 on the internal wall 84 of the slot 56 at a position proximate to the valve 32. The secondary paint reservoir 86 contains a quantity of paint in a position to be quickly picked up by the transfer paint roller 82 regardless of the orientation of the tool 20 with respect to gravitational force. As best shown in FIG. 11, the secondary paint reservoir 86 extends for only a portion of the length of the slot 56.

Figure 10:
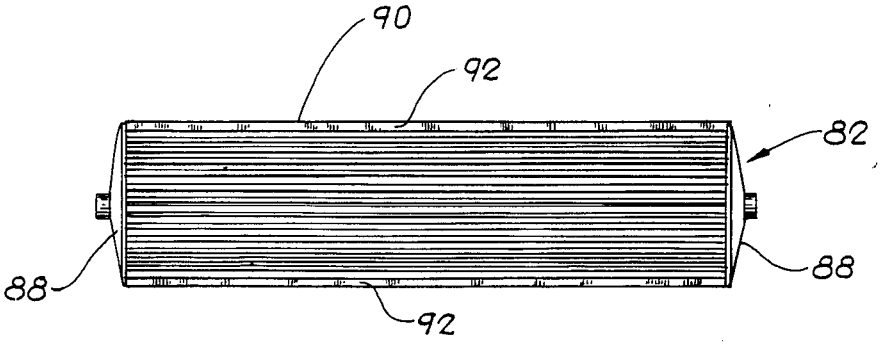
FIG. 10 is a perspective view of the transfer roller shown in FIGS. 6 and 7.

The transfer paint roller 82 includes a pair of disc-shaped end portions 88 and an intermediate portion 90, as best shown in FIG. 10. The end portions 88 have a generally smooth exterior configuration and are conveniently made out of rubber or other elastomeric material. The intermediate portion 90 has a root diameter slightly smaller than the outside diameter of the end portions 88, as indicated in FIG. 11. However, a plurality of projections 92 are defined on the outside surface of the intermediate portion 90 which extend from the surface of the intermediate portion 90 a distance equal to the difference in diameters between the end portions 88 and the intermediate portion 90. In the illustrated embodiment, the projections 92 are illustrated as axially arranged, generally parallel ribs extending from one end portion 88 to the other and having a generally tapering configuration as they extend away from the intermediate portion 90.

With this arrangement only the surfaces of the end portions 88 and the tips of the projections 92 are in surface contact with the applicator paint roller 40. In addition the end portions 88 make abutting contact with the internal wall 84 at the ledges 94 that flank the secondary reservoir 86. Thus a sealing engagement is achieved about the secondary paint reservoir 86 such that the paint, indicated as "D" in FIG. 11, within the secondary paint reservoir 86 is discouraged from seeping between the end portions 88 and the internal wall 84 and moving upwardly between the housing 22 and the rollers 40 and 82 so as to drip out of the slot 56. At the same time the projections 92 provide sufficient frictional engagement with the paint "D" to insure good pickup of the paint from the reservoir 86 and efficient transfer of that paint by the transfer paint roller 82 to the applicator paint roller 40.

Figure 4:
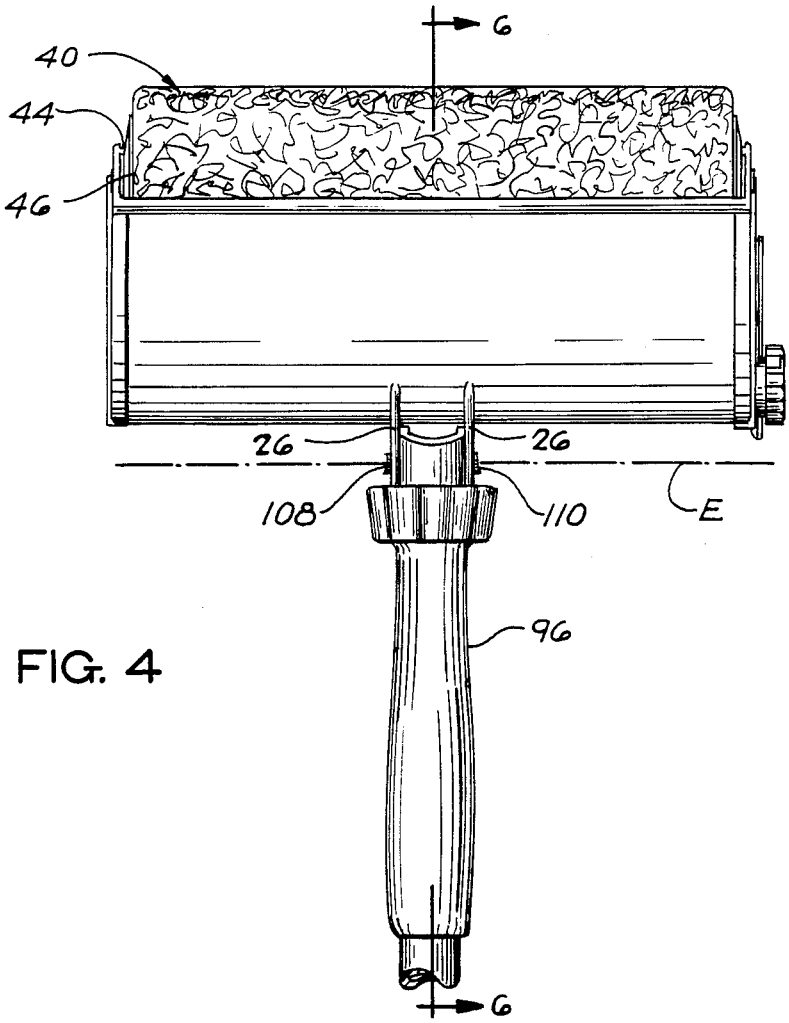
FIG. 4 is a front elevational view of the embodiment shown in FIG. 1.
Figure 16:
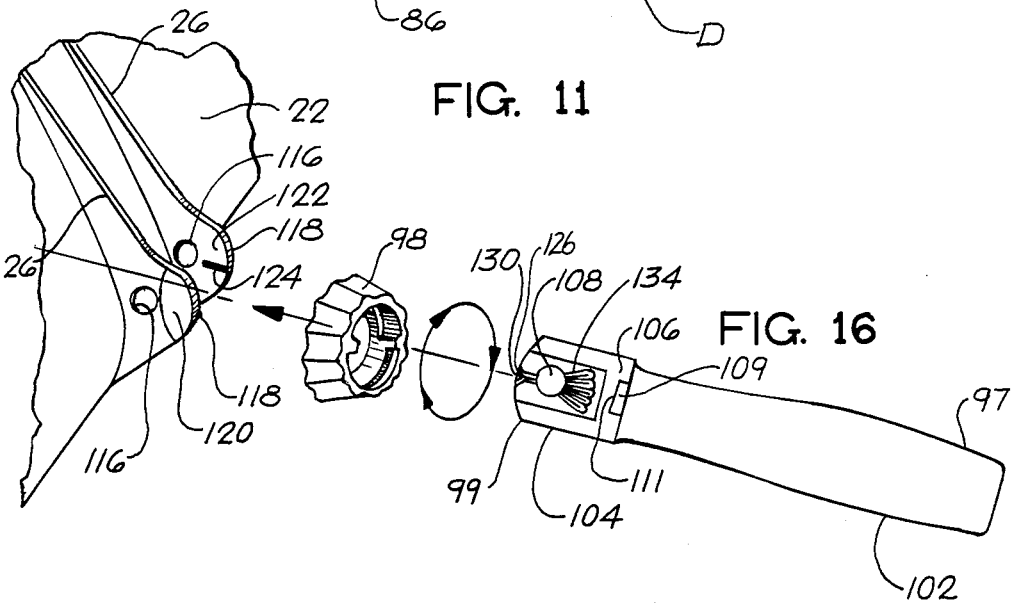
FIG. 16 is a partial, exploded perspective view showing the handle and its manner of attachment to the roller housing.

The handle 24 that engages the brackets 26 includes a manually graspable element 96 and an adjustment ring 98. As indicated in FIG. 6, the interior of the distal end 97 of the element 96 is threaded to receive an extension pole 100. The element 96 includes a first portion 102, nearest the distal end 97, shaped to conform to a user's hand. The second portion 104 nearest the proximal end 99, is somewhat flattened to fit between the brackets 26. The second portion 104 includes a pair of opposed flattened sides 106 each with an outwardly extending camming prong 108. As indicated in FIG. 4, each of the camming prongs 108 has a camshaped end 110 which tapers inwardly toward proximal end 99 of the handle 24. Distally of the flattened sides 106, as shown in FIG. 16, a pair of cams 109 extend out from the element 96. The proximal face 111 of each cam 109 is angled with respect to the line perpendicular to the length of the element 96.

The brackets 26 extend away from the housing 22 so that they are generally parallel to one another but perpendicular to the length of the housing 22. Each of the rounded, generally U-shaped brackets 26 includes a central aperture 116 and a spherical enlarged end 118, as indicated in FIG. 16. The enlarged ends 118 each have a convex, curved portion 120 directed away from the opposite bracket 26 to define a portion of a spherical surface that includes the portions surfaces 120 of each enlarged end 118. The opposed faces 122 of each bracket 26 include a ridge 124, arranged generally perpendicularly to the length of the housing 22 and extending from the tip of each enlarged end 118 to the aperture 116.

The flattened surfaces 106 each include a groove 130 which extends from the proximal end 99 of the element 96 to the prong 108. The portion 126 of the groove 130 closest to the proximal end 99 is widened. In addition a fan-shaped arrangement of angularly related grooves 134 are defined distally of the pin 108 on each flattened side 106. Each of the grooves 134 are angularly related to the other with the center of tne grooves 134 located at the center of the pin 108.

The flattened sides 106 are in abutting engagement with the opposed faces 122 of the brackets 26. As indicated in FIGS. 4 and 14, the element 96 may be inserted between the brackets 26 so that the prongs 108 are held within the apertures 116. This process is facilitated by the ridges 124 which engage the grooves 130 and guide the element 96 between the brackets 26 in the desired alignment. The tapered ends 110 of the prongs 108 cam the brackets 26 apart until the prongs 108 snap into their apertures 116. In this position the ridges 124 are located within the central-most grooves 134. Then the orientation of the element 96 with respect to the housing 22 may be adjusted by pivoting the element 96 about a axis "E" extending through the apertures 116 with the engagement between the ridges 124 and grooves 134 providing a racheting or indexing effect.

Figure 12:
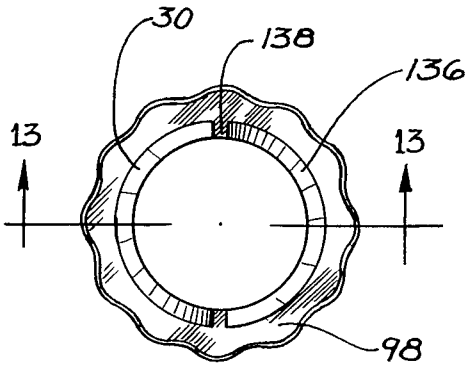
FIG. 12 is a top plan view of the adjusting ring shown in FIG. 1.
Figure 13:
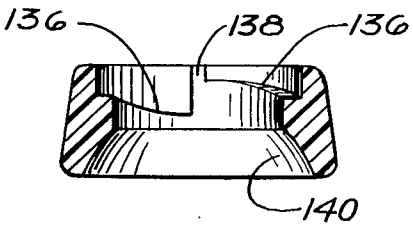
FIG. 13 is a cross-sectional view taken generally along the line 13—13 in FIG. 12.

The adjustment ring 98, shown in FIGS. 12, 13 and 16, that encircles the element 96 has a pair of opposed, internal, helical camming surfaces 136 separated by the blocks 138. Each camming surface 136 is arranged to abut with the face 111 of a different cam 109 on the element 96. Facing outwardly from the opposite side of the ring 98, a generally spherical, concave, surface 140 is defined. As indicated in FIG. 13, the ring 98 has a broadly trapezoidal configuration in cross-section. The concave, surface 140 is arranged to face the enlarged ends 118 and their convex surfaces 120 such that the concave surface defined by the surfaces 120 may mate with the surface 140 on the ring 98.

This permits locking engagement between the ring 98 and the housing 22 and permits adjustment of the angular orientation of the element 96 about the pivot axis extending through the apertures 116, to any desired position to facilitate painting. Particularly by rotating the ring 98 about 90° around the element 96, the camming action between the camming surfaces 136 and the cams 109 translates the ring 98 axially from a distal position to a proximal position. This results in frictional engagement between the ring 98 and the surfaces 120 of the brackets 26, releasably fixing the element 96 with respect to the housing 22. In addition the engagement between the ridges 124 and the grooves 134 further promotes the releasable locking engagement.

The working axis of the tool 20, defined by an imaginary line connecting the axis "B" of the roller 40 to the axis "E" of the handle 24 is offset from the axis "0" of the roller 82, as indicated in FIG. 7. This efficiently enables a compact arrangement of the device 20.

The painting tool 20 is operated as follows. Initially, the user snaps the applicator paint roller 40 into the housing 22. This is done by positioning a pair of end walls 46 within a cover 42 and snapping the assembly into the appropriate apertures in the housing 22. The cap 28 is then removed and the reservoir 54 is loaded with paint. Thereafter the cap 28 is replaced and sealed in a closed position. Next, the desired rate of paint application to the surface to be painted is set by adjusting the position of the pointer 36 with respect to the scale 38 thereby rotating the valve stem 66. As the valve 32 rotates from the position shown in FIG. 6 to the position shown in FIG. 7, an increasing rate of paint transfer is pre-determined. Of course, the user can set any position between those shown in FIGS. 6 and 7 to adjust a paint flow as desired.

Next, the orientation of the handle 24 with respect to the housing 22 is set. This is simply accomplished by snapping the proximal end 99 of the element 96 between the brackets 26 so that the prongs 108 extend through the apertures 116 in the brackets 26. The orientation of the element 96 with respect to the housing 22 about the axis extending through the apertures 116 is then fixed by orienting the element 96 in the desired position and rotating the ring 98 in a clockwise direction. Engagement between the camming surfaces 136 and the cams 109 causes the ring 98 to translate towards the housing 22. Eventually, frictional locking engagement is achieved between the concave surface 140 of the ring 98 and the convex surfaces 120 of the enlarged ends 98 which together define portions of the same spherical surface. Next, an extension pole 100 may be threaded into the handle 24, if desired.

With the desired orientation between the handle 24 and housing 22 achieved, the user rubs the applicator paint roller 40 over the surface to be painted. The rotation of the applicator paint roller 40 rotates the transfer paint roller 82. At the same time paint is fed from the reservoir 54 to the secondary paint reservoir 86 at a rate controlled by the orientation of the valve 32. As the paint begins to collect in the secondary reservoir 86, it starts to be picked up by the projections 92 of the intermediate portion 90. As a result the paint is transferred from the transfer roller 82 to the applicator roller 40 and then to the surface to be painted, indicated as "F" in FIG. 1.

Leakage of paint from the slot 56 is minimized due to the arrangement of the transfer roller 82 within the slot 56. Specifically the outside of the end portions 88 abut with internal wall 84 of the housing 22 at the ledges 94 so that paint may not gravitate laterally around the ends of the rollers 40 and 82. In addition paint is discouraged from gravitating circumferentially about the transfer roller 82 other than in engagement with the projections 92 thereon, by the close proximity between the outside surface of the transfer roller 82 and the humps 87 of the slot 56.

Because of the weight and size of the painting tool 20, the ability to easily adjust the orientation of the handle 24 with respect to the housing 22 is of great value since it may often be necessary to adjust this orientation during different stages of the painting process. With the arrangement illustrated, this procedure may be accomplished by a simple operation while the reservoir 54 is full of paint.

While the present invention has been described with respect to a single preferred embodiment, those skilled in the art will appreciate a number of modifications and it is intended within the appended claims to cover all such modifications that come within the true spirit and scope of the invention.

What is claimed and desired to be covered by Letters Patent is:

1. A painting tool, comprising:

a housing including a handle;

a first paint reservoir;

a secondary paint reservoir;

a roller containing cavity within said housing having an internal wall defining a pair of sealing ledges which flank the secondary reservoir at either end of said housing;

a first paint roller rotatably mounted within said housing;

a second, paint transfer roller rotatably mounted within said cavity rotating engagement with said first paint roller and in fluid communication with said first paint reservoir such that is transferred from the surface of the second, paint transfer roller to the surface of the first paint roller, said second, paint transfer roller having a pair of end portions and an intermediate portion between said end portions, said end portions having a larger diameter than said intermediate portion and arranged to rotate in sealing abutment with the sealing ledges of said housing, said intermediate portion including a plurality of projections spaced about said second paint transfer roller defining a paint transfer means, said secondary paint reservoir being defined generally intermediately of said second, paint transfer roller, adjacent said intermediate portion, to transfer paint thereto; and a removable, rotary valve between said first and secondary paint reservoirs including an integrally formed generally arcuate valve casing defining on its forward end a slot segment projecting into said secondary paint reservoir and on its rearward side a stop means at the end of said first reservoir, said valve further including a valve stem adapted to be removably snap fit in said valve casing, said stem defining a generally cylindrical portion journalled in said casing and a wiper portion extending diametrically away from said cylindrical journalled portion, said wiper defining a movable closure for regulating paint flow from the first reservoir to the secondary reservoir in response to rotation of said journalled portion of the valve, said rotation occurring in an arc defined by translation of said wiper from a first limiting contact thereof with said forward slot segment and a second limiting contact with said stop means.

* * * * *